US011986117B1

(12) United States Patent
Holland

(10) Patent No.: US 11,986,117 B1
(45) Date of Patent: May 21, 2024

(54) THROW BLANKET WITH WARMING POCKETS FOR THE HANDS AND FEET

(71) Applicant: Elizabeth M. Holland, El Cerrito, CA (US)

(72) Inventor: Elizabeth M. Holland, El Cerrito, CA (US)

( * ) Notice: Subject to any disclaimer, the term of this patent is extended or adjusted under 35 U.S.C. 154(b) by 141 days.

(21) Appl. No.: 17/540,666

(22) Filed: Dec. 2, 2021

Related U.S. Application Data

(60) Provisional application No. 63/236,796, filed on Aug. 25, 2021.

(51) Int. Cl.

| | |
|---|---|
| ***A41D 3/08*** | (2006.01) |
| ***A41D 15/04*** | (2006.01) |
| ***A47G 9/02*** | (2006.01) |
| ***A47G 9/06*** | (2006.01) |

(52) U.S. Cl.
CPC ..... *A47G 9/0223* (2013.01); *A47G 9/066* (2013.01)

(58) Field of Classification Search
CPC ..... A47G 9/066; A47G 9/064; A47G 9/0223; A41D 3/08; A41D 15/04
See application file for complete search history.

(56) References Cited

U.S. PATENT DOCUMENTS 3,919,721 A * 11/1975 Earhart ..... A47G 9/066 2/69
4,507,805 A * 4/1985 Calutoiu ..... A41D 15/04 5/413 R
4,916,756 A * 4/1990 Barrett ..... A47G 9/066 2/69.5
5,257,427 A * 11/1993 Hinshaw ..... A47G 9/086 5/613
5,901,375 A * 5/1999 Davis ..... A41D 15/04 2/84
6,851,127 B1 * 2/2005 Khan ..... A47G 9/066 2/84
6,968,582 B1 * 11/2005 Barton ..... A47G 9/0238 5/486
7,178,185 B1 2/2007 Nattler
7,520,889 B2 4/2009 Van Duren
7,779,492 B2 8/2010 Mangano
(Continued)

FOREIGN PATENT DOCUMENTS

EP 2448438 B1 12/2017

*Primary Examiner* — Justin C Mikowski
*Assistant Examiner* — Ifeolu A Adeboyejo
(74) *Attorney, Agent, or Firm* — Mark D. Bowen, Esq.; Malin Haley DiMaggio & Bowen, P.A.

(57) ABSTRACT

A throw blanket having specially configured hand and feet pockets that insulate the hands and feet while allowing virtually full use of the user's hands comprises a generally flat blanket having upper left and right corners configured with hand pockets and a central lower edge configured with a pocket for the feet. Hand pockets are uniquely structured with a thumb slit and finger opening which allow for certain of the user's fingers and thumb to project from the pocket thereby enabling the user to continue to grasp, hold, and manipulate beverage glasses, books, TV and entertainment center remote control devices, and the like. The foot pockets are formed with specially configured fold which allows for easy insertion of the user's feet while allowing the pocket material to conform around the user's feet and ankles.

6 Claims, 5 Drawing Sheets

(56) References Cited

U.S. PATENT DOCUMENTS

| | | | | |
|---|---|---|---|---|
| 8,464,374 | B1 | 6/2013 | Thayer | |
| 8,707,481 | B1 | 4/2014 | Juarez | |
| 9,386,814 | B2 * | 7/2016 | Flora | A41D 15/04 |
| 9,439,463 | B1 * | 9/2016 | Spears | A41D 3/08 |
| 9,795,225 | B2 | 10/2017 | Moses | |
| 10,265,636 | B2 | 4/2019 | Anderman et al. | |
| 2001/0014988 | A1 | 8/2001 | Bartosik | |
| 2001/0032360 | A1 * | 10/2001 | Bertrand | A47G 9/066 5/482 |
| 2002/0129445 | A1 * | 9/2002 | Deering | A47G 9/066 5/482 |
| 2006/0130234 | A1 * | 6/2006 | Poulin | A47G 9/0238 5/486 |
| 2010/0059558 | A1 * | 3/2010 | Robinson | A47G 9/066 2/88 |
| 2012/0005801 | A1 * | 1/2012 | Parr | A41D 3/08 2/84 |
| 2013/0239290 | A1 * | 9/2013 | Rossi | A41D 15/04 2/84 |
| 2015/0366382 | A1 | 12/2015 | Ostolaza-Torres | |
| 2018/0064269 | A1 * | 3/2018 | Carlile | A47G 9/0223 |
| 2018/0360241 | A1 | 12/2018 | McClellan-Miller | |
| 2019/0208936 | A1 | 7/2019 | Thomas | |
| 2021/0278076 | A1 * | 9/2021 | Dhirmalani | A41D 1/002 |
| 2022/0175161 | A1 * | 6/2022 | MacLaurin | A47G 9/086 |

* cited by examiner

FIG. 1A
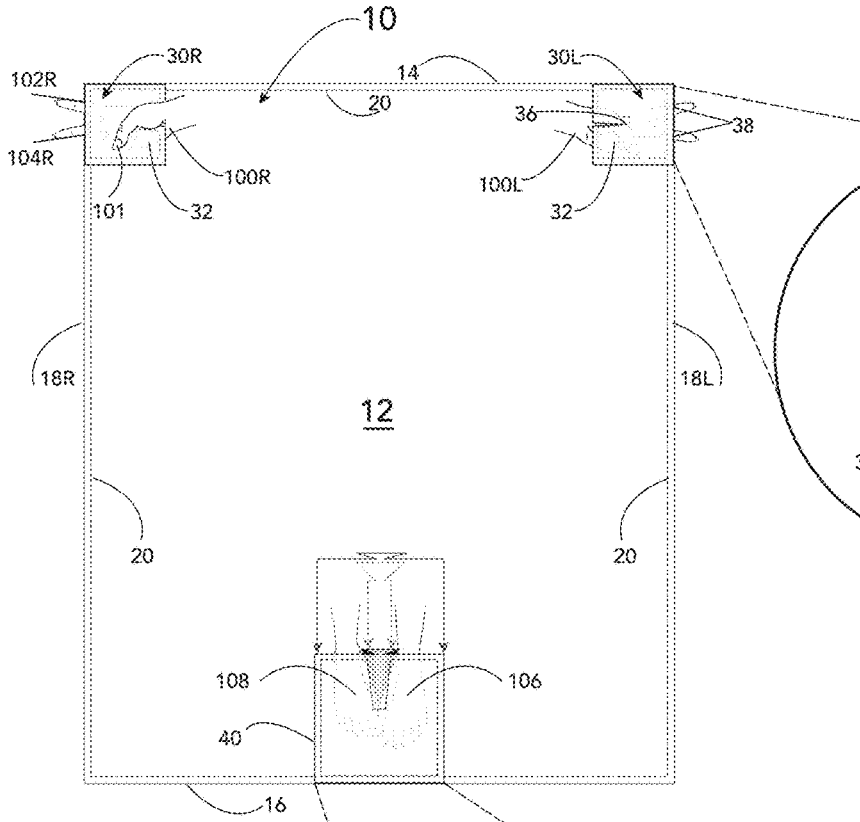
FIG. 1B
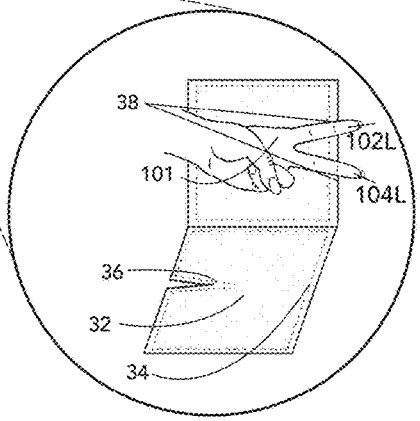
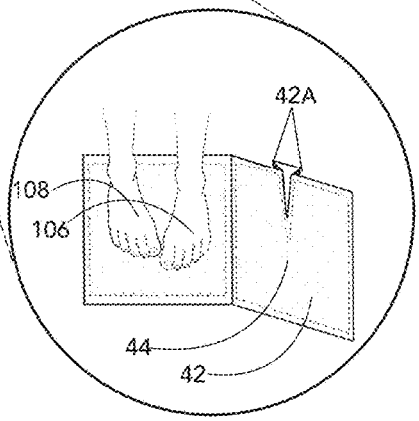
FIG. 1C

THROW BLANKET WITH WARMING POCKETS FOR THE HANDS AND FEET

CROSS REFERENCE TO RELATED APPLICATIONS

This application claims the benefit of provisional U.S. Patent Application Ser. No. 63/236,796, filed on Aug. 25, 2021.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to blankets, and more particularly to a throw blanket having pockets for receiving the user's hands and feet.

2. Description of Related Art

Blankets are fabricated from soft cloth material and sized to cover a great portion of the user's body while asleep or otherwise at rest. Blankets come in a variety of sizes, shapes, and configurations. In addition, specialty blankets, such as baby blankets and military blankets are well known. Generally speaking, blankets are used to provide the user with warmth and comfort. While the use of blankets as bed coverings are universal, smaller blankets, commonly referred to as "throws" are employed for use while the user is lounging, reading, watching television or movies, or simply relaxing on a couch.

It is well known that an important aspect of thermal comfort relates to preventing a person's extremities, namely the hands and feet, from becoming cold. From an anatomical perspective the hands and feet are most susceptible to feeling cold since the human body is designed to regulate its own temperature by increasing blood flow to the body's core and vital organs to keep them warm in cold environments. As a result, this can change the volume of blood flowing to the hands and feet, making them feel cold.

The background art reveals throw blankets intended to address the problems associated with conventional blankets by providing integrally formed pockets for the hands and feet. For example, U.S. Pat. No. 6,851,127, issued to Khan, disclose a multipurpose blanket having pockets disposed along the inner surface thereof to accept the hands of the user. U.S. Pat. No. 7,779,492, issued to Mangano, discloses a blanket having accessory pockets formed adjacent to the corners for retaining objects or for placement of the person's hands. U.S. Pat. No. 8,464,374, issued to Thayer, discloses a blanket having a head opening and a plurality of foot pockets formed on the lower portion of the blanket. U.S. Pat. No. 8,707,481, issued to Juarez, discloses an extremity warming blanket adapted to allow the user to place their hands and feet into insulated pockets to maintain the extremities warm and wherein the foot pockets are in the form of slippers or socks.

The blanket configurations revealed in the background art are burdened with deficiencies and short comings that have prevented widespread acceptance and use. As a result, there remains a need in the art for improvements and advancements in the art of blanket configurations.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The present invention overcomes the disadvantages and limitations in the art of throw blankets by providing a throw blanket having specially configured hand and feet pockets that insulate the hands and feet while allowing virtually full use of the user's hands. A throw blanket in accordance with the present invention comprises a generally flat blanket having upper left and right corners configured with hand pockets and a central lower edge configured with a pocket for the feet. The hand pockets are uniquely structured with a thumb slit and finger opening which allow for certain of the user's fingers and thumb to project from the pocket thereby enabling the user to continue to grasp, hold, and manipulate beverage glasses, books, TV and entertainment center remote control devices, and the like. The foot pockets are formed with specially configured fold which allows for easy insertion of the user's feet while allowing the pocket material to conform around the user's feet and ankles. Each of the pockets are preferably lined with fleece or other suitable material, for additional warmth. A further significant aspect of the present invention involves providing folding steps that allow the throw blanket to be folded into a configuration wherein the hands and feet pockets are concealed whereby the blanket has the outward visual appearance of a conventional throw.

The blanket of the present invention may further be configured for outdoor use. In accordance with this aspect of the present invention.

Accordingly, it is an object of the present invention to provide advancements in the field of blankets and throw blankets.

It is another object of the present invention to provide a throw blanket having pockets for the hands and feet to promote warmth.

Still another object of the present invention is to provide an improved throw blanket adapted with hand pockets that allow for the use of the user's fingers and thumb to preserve the user's ability to grasp, hold, and manipulate objects.

Yet another object of the present invention is to provide an improved throw blanket having foot receiving pockets wherein a pleated panel to permit the pocket material to easily receive the user's feet while conforming snugly around the ankles.

It is another object of the present invention to provide a throw adapted with hand and foot pockets which is foldable into a folded configuration wherein the pockets are concealed.

Still another object of the present invention is to provide a improved throw blanket adapted with a waterproof layer for use outdoors.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 1A illustrates a throw blanket with warming pockets for the hands and feet in accordance with the present invention;

FIG. 1B is a partial detailed view of the hand pocket portion thereof;

FIG. 1C is a partial detailed view of the feet pocket portion thereof;

DETAILED DESCRIPTION OF THE INVENTION

Figure 2A:
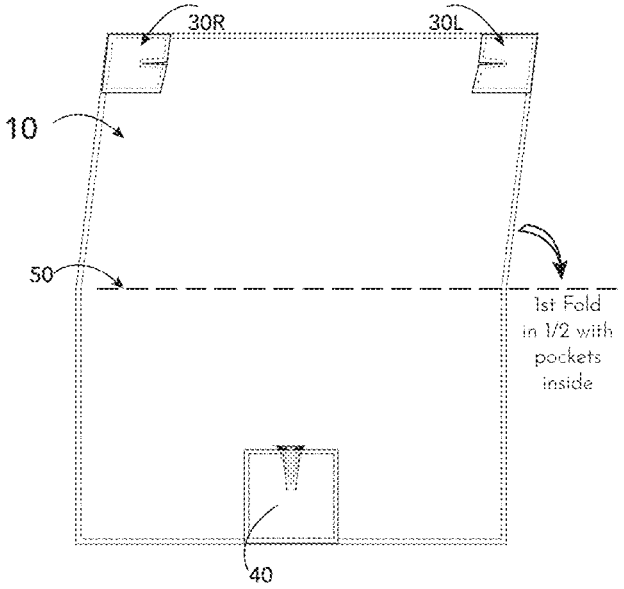
FIG. 2A depicts the throw blanket at the initiation of a first folding step.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

In describing this invention, the word "connected" is used. By "connected" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another. By adjacent to a structure is meant that the location is near the identified structure.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Turning now to the drawings, FIGS. 1A-1C and 2A-2E illustrate a throw blanket, generally referenced as 10, having hand and feet warming pockets in accordance with the present invention. Throw blanket 10 is characterized as a personal blanket for use by an individual while seated or resting as distinguished from a full-size blanket used as a bed covering. Throw blanket 10 includes a main blanket body 12 formed of a suitable non-rigid material, such as fleece, cotton, wool, piled or woven fabric, or any other suitable natural or synthetic material. FIG. 1A illustrates what is considered the interior side of throw blanket 10, namely the side that contacts the user, with the opposing side being the exterior side. Main blanket body 12 includes top portion 14, a bottom portion 16, opposing left and right side edges, referenced as 18L and 18R respectively, each of which are finished at the peripheral edge thereof by a hem or stitched seam 20. Sides 18L and 18R are labeled with reference to the user's left and right-hand side. In one embodiment, main blanket body 12 has a length of approximately 76-inches when measured from top 14 to bottom 16, and a width of approximately 64" when measured from right side 18R to left side 18L. The dimensions, however, may be altered to any suitable size. Accordingly, any dimensions discussed herein are not intended to be limiting with respect to the present invention.

A significant aspect of the present invention is providing a throw blanket with specially configured hand and feet warming pockets as seen in FIGS. 1A-1C, and as more fully discussed herein below. In accordance with this aspect of the invention, left and right-hand pockets, generally referenced as 30L and 30R respectfully, are disposed in proximity to the upper left and right corners of main body 12 as shown in FIG. 1A, and configured for receiving the corresponding left 100L and right 100R hands of the user when in use. Hand pockets 30L and 30R are preferably disposed in the corresponding upper left-hand and right-hand corners of main body 12, or in proximity thereto, however, alternate locations may be employed without departing from the scope of the present invention. Hand pockets 30L and 30R may be formed on one side of blanket main body 12, namely the side in contact with the user and adjacent to the dorsal aspect of the human hand when in use. Hand pockets 30L and 30R include a pocket forming layer 32 disposed on the palmar aspect of the human hand. Hand pockets 30L and 30R are preferably lined with a thermally insulating material, referenced as 34, such as fleece or any other suitable material.

A significant aspect of the present invention involves providing hand pockets that are uniquely structured with a thumb slit, referenced as 36, and a finger(s) opening, referenced as 38 which allow for certain of the user's fingers and thumb to project from the pocket thereby enabling the user to continue to grasp, hold, and manipulate beverage glasses, books, TV and entertainment center remote control devices, and the like. Each pocket may have a hand opening spaced from, and in parallel alignment with, the corresponding side edge of main body 12, or may be otherwise oriented. Each pocket fabric portion 32 defines a slit 36, that may be V-shaped, U-shaped, or merely a discontinuity in fabric 32. In an alternate embodiment slit 36 may be replaced with a thumb hole or other passage for allowing the user's thumb to project from the pocket. Accordingly, as used herein the term "passage" shall broadly be construed to encompass a slit, hole, or other discontinuity that allow the user's thumb to project from the pocket. Slit 36 allows for passage of the user's thumb 101 toward the peripheral edge as the hand is inserted into the pocket thereby allowing the hand to proceed further past the pocket opening than it would otherwise be able. Each V-shaped slit 36 originates on the internal edge of the pocket opening formed by the pocket fabric 32 and extends toward the side edge of blanket main body 12. Slit 36 preferably has a length of approximately 3-inches, or other suitable length. It is contemplated however that the exact location, shape, and length of slit 36 may be varied within the scope of the present invention. At least one opening 38 is formed along the coextensive edges of pockets 30L and 30R, with corresponding edges of sides 18L and 18R as best seen in FIGS. 1A and 1B. In a preferred embodiment, each finger opening 38 extends approximately 2-3 inches in length, a size which has been found sufficient to allow at least the user's index and middle fingers, referenced as 102L and 104L respectively in FIG. 1B. Providing V-shaped slits 36 and finger openings 38 allow the user to insert his/her hand into each pocket 30L and 30R while leaving his/her thumb and at least two fingers functionally exposed to enable the user to grasp and use articles such as cups, TV remote control devices and the like without having to remove the hand(s) from the pocket(s). The dimensions herein are provided in connection with one embodiment of the present invention and are not intended to be limiting.

Yet another significant aspect of the present invention involves providing a foot pocket, generally referenced as 40, for the user's feet, including the left foot 106 and right foot 108. Foot pocket 40 is preferably located centrally between side edges 18L and 18R along the bottom 16 of main body 12. Foot pocket 40 may be formed on one side of blanket main body 12. Foot pocket 40 may be formed by a portion of pocket fabric, referenced as 42. Pocket fabric 42 preferably defines an upper edge forming a pleat or triangular fold, referenced as 42A, which enables the pocket opening to expand to allow for easy insertion of the user's feet while further enabling the pocket to conform around the user's ankles after insertion of the feet. Foot pocket 40 is preferably lined with a thermally insulating material, referenced as 44, such as fleece or any other suitable material. Foot pocket 40 is preferably approximately 12-16 inches in width (i.e. measured from side-to-side), however foot pocket 40 may be fabricated to any suitable dimensions. In an alternate embodiment, the present invention may be adapted with separate first and second foot pockets.

Figure 2B:
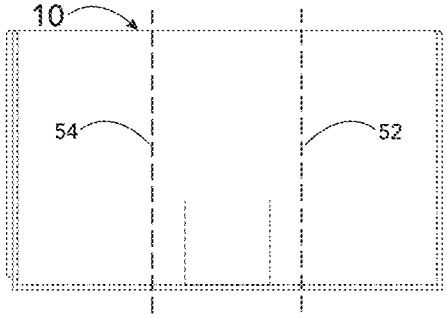
FIG. 2B depicts the throw blanket at the conclusion of the first folding step.
Figure 2C:
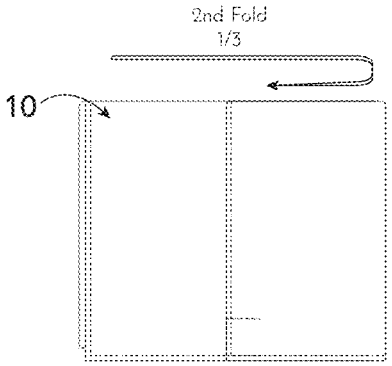
FIG. 2C depicts the second folding step.
Figure 2D:
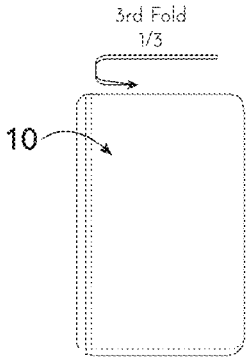
FIG. 2D depicts the third folding step.
Figure 2E:
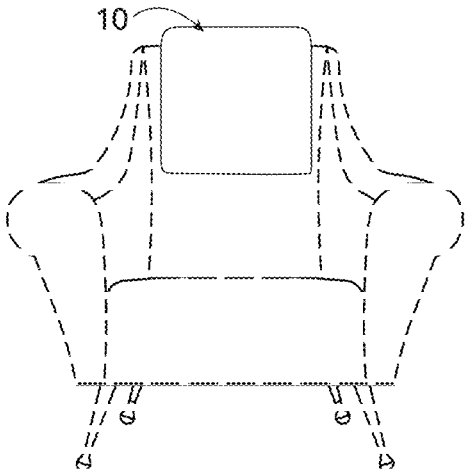
FIG. 2E illustrates the throw blanket in a fully folded configuration upon a chair.

FIGS. 2A-2E illustrate a further significant aspect of the present invention which involves a method of folding steps that allow the throw blanket to be folded into a configuration wherein the hands and feet pockets are concealed whereby the blanket has the outward visual appearance of a conventional throw. FIG. 2A depicts throw blanket 10 at the initiation of a first folding step about a transverse fold line 50 where, upon completion of the fold, throw blanket 10 is generally folded in half with the hand pockets and foot pocket disposed on the interior of the folded blanket as illustrated in FIG. 2B. As also seen in FIG. 2B hand pockets 30L and 30R, and foot pocket 40, concealed within the interior of the folded throw. Second and third folding steps are preformed about fold lines 52 and 54 shown in FIG. 2B. FIG. 2C illustrates throw blanket 10 after completion of the second fold about fold line 52, and FIG. 2D illustrates throw blanket 10 after completion of the third fold about line 54. Finally, FIG. 2E illustrates the throw blanket in a fully folded configuration upon a chair.

Figures 3A, 3B, 3C, 3D, 3E:
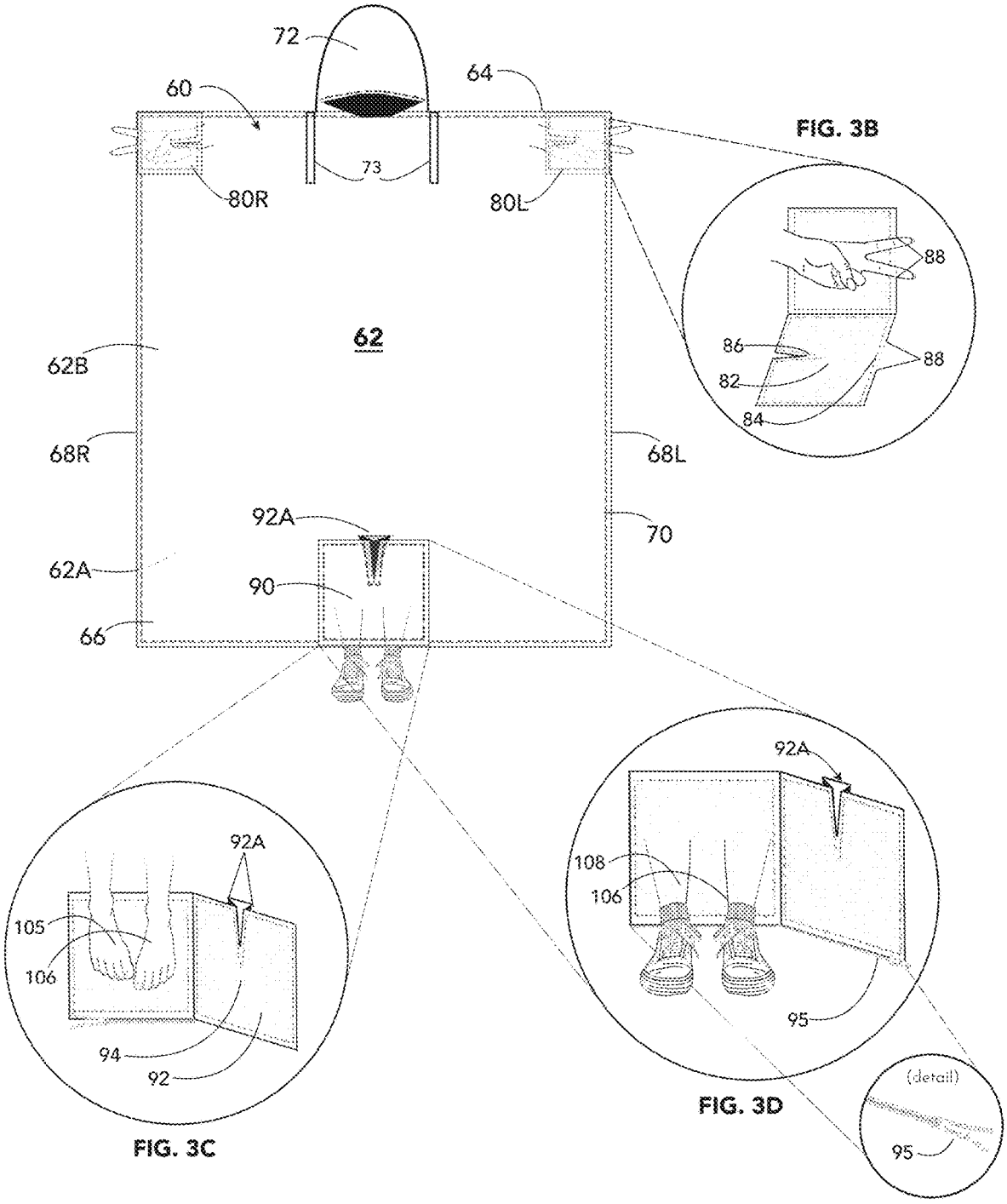
FIG. 3A depicts an alternate embodiment blanket designed for outdoor use in accordance with the present invention.
FIG. 3B is a partial detailed view of the hand pocket portion thereof.
FIG. 3C is a partial detailed view of the feet pocket portion illustrating use with bare feet.
FIG. 3D is a partial detailed view of the feet pocket portion illustrating use with shoes.
FIG. 3E is a partial detailed view illustrating a portion of the zipper.
Figure 4:
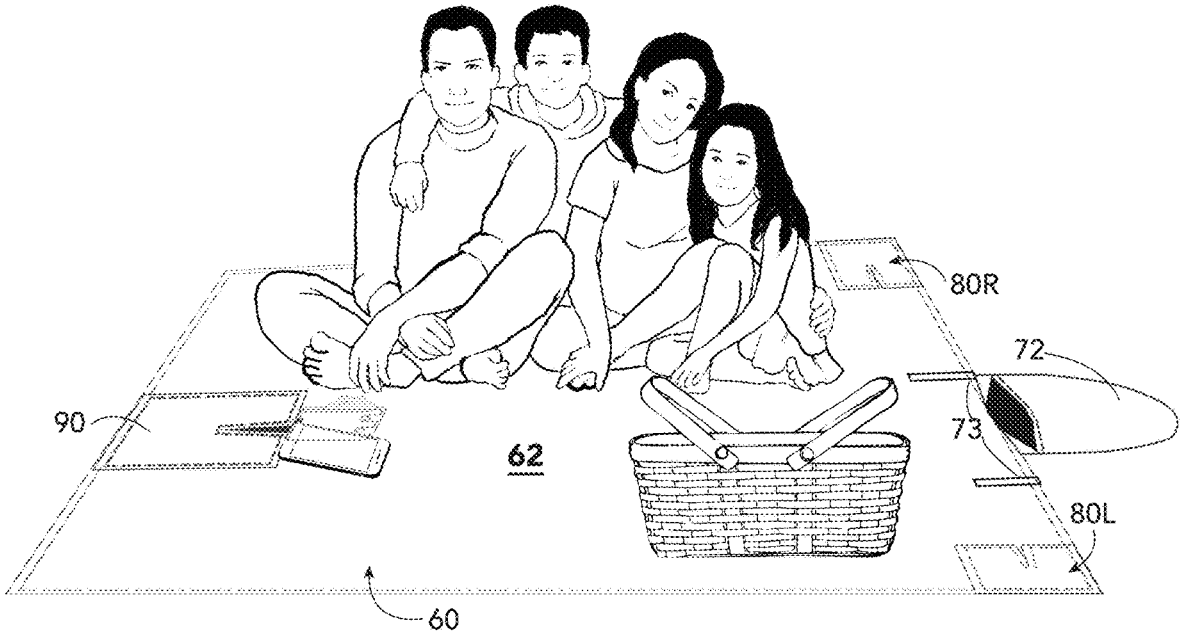
FIG. 4 depicts the alternate embodiment blanket configured for use outdoors as a picnic blanket.

FIGS. 3A-3E depict an alternate embodiment blanket, generally referenced as 60, configured for use outdoors. Blanket 60 shares many of the structural aspects of the throw blanket embodiment disclosed herein above. Blanket 60 includes a main blanket body 62 having a back outside layer 62A formed of a waterproof material, such as GORE-TEX®. GORE-TEX is a registered trademark of W.L. Gore & Associates, Inc. Forming the outside layer of a waterproof material functions to keep the user thy when raining and further allows the blanket to be used as a picnic blanket with the waterproof material disposed in contact with the underlying ground as illustrated in FIG. 4. Main blanket body 62 further includes in front inside layer 62B formed of a suitable non-rigid material, such as fleece, cotton, piled or woven fabric, or any other suitable natural or synthetic material. FIG. 3A illustrates what is considered the inside or interior side 62B of throw blanket 60, namely the side that contacts the user, with the opposing exterior or outside 62A being the opposite side in contact with the ground. As with the previously disclosed embodiment, main blanket body 62 includes top portion 64, a bottom portion 66, opposing left and right sides, referenced as 68L and 68R respectively, each of which are finished at the peripheral edge thereof by a hem or stitched seam 70. A hood, referenced as 72, is connected along the top portion 64 of main body 60. In addition, a chin strap 73 formed by a pair of attachable straps is disposed along the top portion of main body 60. The straps may be connected by hook and loop fastening material, buttons, or any other means of attachment.

As with the previously disclosed embodiment blanket 60 includes hand and feet warming pockets including left and right-hand pockets, generally referenced as 80L and 80R respectfully and a pocket structure 90 for receiving the user's feet. As best seen in FIGS. 3A and 3B, left and right-hand hand pockets 80L and 80R have structures for receiving the user's hands as disclosed above, including a pocket-forming fabric layer referenced as 82, a lining (such as fleece) 84, a thumb slit 86, and an opening 88 for the user's fingers.

As best seen in FIGS. 3C, 3D, and 3E, foot pocket structure 90 defines pocket forming layer 92 having an upper edge forming a pleat or triangular fold, referenced as 92A, which allows for easy insertion of the user's feet while allowing the pocket to conform around the user's ankles after insertion of the feet. Foot pocket 90 is preferably lined with a thermally insulating material, referenced as 94, such as fleece or any other suitable material. In addition, foot pocket 90 and more particularly pocket forming layer 92 includes a bottom edge that is removably connected to a corresponding portion of bottom edge 66 by a mechanical fastening system 95, such as a zipper, hook and loop fastening material, or the like, which allows for the detachment of the bottom to allow the user's feet 106 and 108 to pass through the pocket as seen in FIG. 3A. Fastening system 95 may function to form an opening along the bottom of foot pocket 90, or in the alternative may allow for complete detachment of pocket forming layer 92. This feature is particularly significant when blanket 60 is in use to keep the user warm when sitting outdoors while wearing shoes as the shoes can pass through the opening.

FIG. 4 depicts blanket 60 in use as a picnic blanket. In this configuration, hood 72, foot pocket 90, and hand pockets 80L and 80R may be used for storage of articles and/or for weighing down the main blanket body.

Figure 5A:
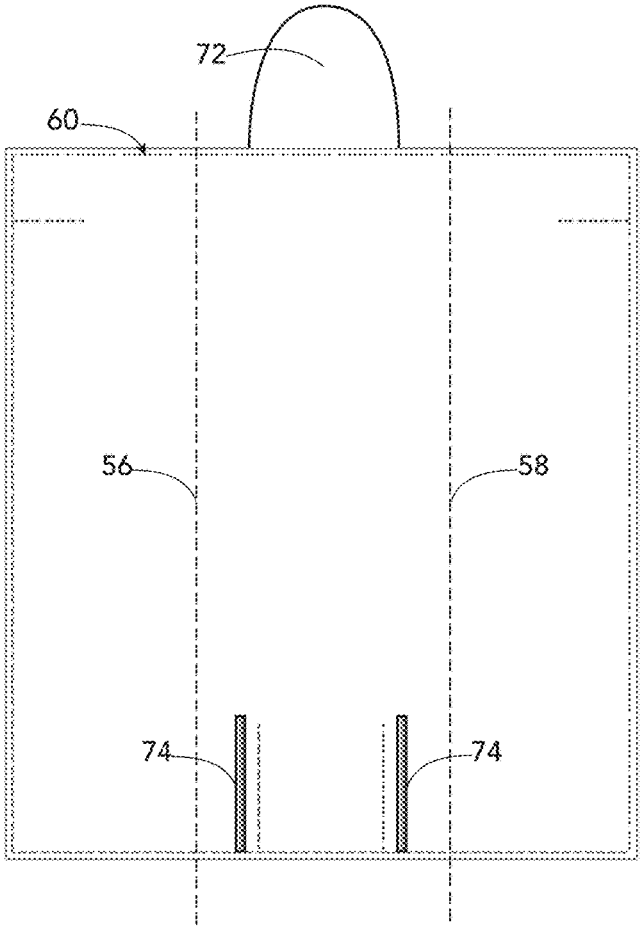
FIGS. 5A-5E illustrate configuring the alternate embodiment blanket into a compact rolled configuration.
Figure 5B:
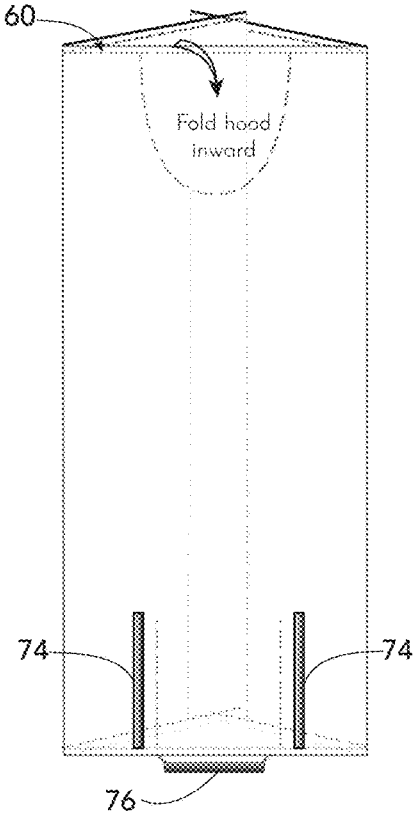
Figure 5C:
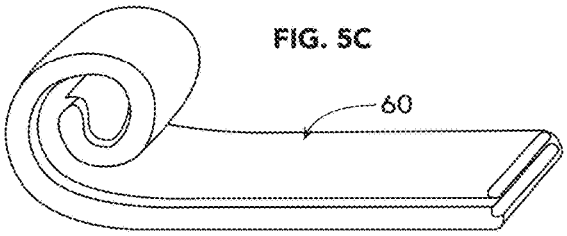
Figure 5D:
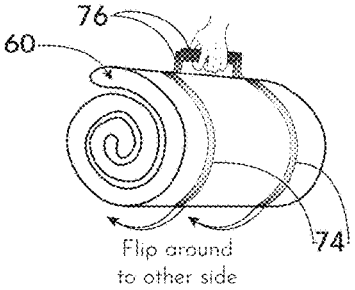
Figure 5E:
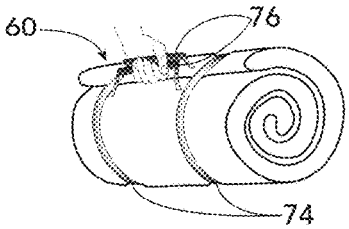

FIGS. 5A-5E illustrate configuring the alternate embodiment blanket into a compact rolled configuration. As best seen in FIGS. 5A and 5B initial first and second folds are preformed about fold lines 56 and 58 respectively. Next, blanket is rolled from the hood end into a compact roll as illustrated in FIG. 5C. A pair of elastic straps 74 are slid around the rolled main body 62 as seen in FIG. 5D. Finally, a handle 76 is provided to facilitate the carrying of blanket 60 in the rolled-up configuration.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A throw blanket comprising:

a main blanket body including a front and a back, said main blanket body further including a top portion, a bottom portion, a left side edge, and a right side edge;

at least two hand pockets disposed on the front of said main body in proximity to said top portion, including a left hand pocket and a right hand pocket, said left hand pocket disposed in proximity to said left side edge and said right hand pocket disposed in proximity to said right side edge;

each of said hand pockets defining an opening and including a V-shaped thumb slit originating at an internal edge of the pocket opening and extending toward the respective side edge of said blanket body;

each of said hand pockets including an opening formed along coextensive edges of said pocket and the side edge of said blanket body; and at least one foot pocket disposed in proximity to said bottom portion.

2. The throw blanket according to claim 1, wherein each of said hand pockets and said at least one foot pocket is internally lined with thermally insulating material.

3. The blanket according to claim 1, wherein said at least one foot pocket is formed by pocket fabric having a pleated upper edge.

4. The blanket according to claim 1, wherein said at least one foot pocket has bottom edge configurable between open and closed configurations.

5. The blanket according to claim 1, further including a hood connected to said top portion.

6. The blanket according to claim 1, wherein the back of said main body is formed of waterproof material.

* * * * *